US008696105B1

(12) United States Patent
Moorlag et al.

(10) Patent No.: US 8,696,105 B1
(45) Date of Patent: Apr. 15, 2014

(54) THERMALLY SWITCHABLE TRANSFIX BLANKET MADE OF BLENDED POLYMERS FOR INDIRECT PRINTING METHODS

(71) Applicant: Xerox Corporation, Norwalk, CT (US)

(72) Inventors: Carolyn P. Moorlag, Mississauga (CA); Gabriel Iftime, Mississauga (CA); Sarah J. Vella, Milton (CA); Barkev Keoshkerian, Thornhill (CA)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/746,910

(22) Filed: Jan. 22, 2013

(51) Int. Cl.
*B41J 2/01* (2006.01)
*G03G 15/16* (2006.01)

(52) U.S. Cl.
CPC ..... *G03G 15/161* (2013.01)
USPC ..... 347/103; 347/105

(58) Field of Classification Search
CPC ..... G03G 15/162; B41J 2/0057
USPC ..... 347/101, 103, 105
See application file for complete search history.

(56) References Cited

U.S. PATENT DOCUMENTS 5,389,958 A 2/1995 Bui et al.
8,187,711 B2 * 5/2012 Wu et al. ..... 428/412
8,293,369 B2 * 10/2012 Wu et al. ..... 428/421
8,349,463 B2 * 1/2013 Wu et al. ..... 428/473.5
8,377,523 B2 * 2/2013 Wu ..... 428/32.69
2010/0251914 A1 10/2010 Zhou et al.
2010/0330305 A1 12/2010 Wu
2011/0104499 A1 5/2011 Wu et al.
2011/0244202 A1 10/2011 Wu et al.
2011/0244247 A1 10/2011 Wu et al.
2012/0049121 A1 3/2012 Wu

OTHER PUBLICATIONS

Mori et al., "Temperature Induced Changes in the Surface Wettability of SBRA+PNIPA Film," 292 Macromol. Mater. Eng., vol. 917, pp. 917-922, 2007.
Galaev et al., "Thermoreactive water-soluble polymers, nonionic surfactants, and hydrogels as reagents in biotechnology," Enzyme Microb. Technol., May 1993, pp. 354-366, vol. 15, Butterworth-Heinemann.
U.S. Appl. No. 13/746,920, filed Jan. 22, 2013 to Moorlag et al.

* cited by examiner

*Primary Examiner* — Huan Tran
(74) *Attorney, Agent, or Firm* — Oliff PLC

(57) ABSTRACT

A polymer composition contains a stimulus-responsive polymer dispersed in a base polymer matrix. The surface free energy of the stimulus-responsive polymer may be reversibly adjustable from a first surface free energy state to a second surface free energy state when heated to a predetermined critical activation temperature. A method of preparing a polymer composition comprises dispersing a stimulus-responsive polymer in a base polymer matrix. A method of printing an image to a substrate comprises applying an aqueous inkjet ink onto an intermediate transfer member using an inkjet printhead, spreading the ink onto the intermediate transfer member, inducing a property change of the ink, and transferring the ink to a substrate, where the intermediate transfer member contains a stimulus-responsive polymer dispersed in a polymer matrix.

20 Claims, 2 Drawing Sheets

THERMALLY SWITCHABLE TRANSFIX BLANKET MADE OF BLENDED POLYMERS FOR INDIRECT PRINTING METHODS

TECHNICAL FIELD

The present disclosure is generally related to indirect printing methods, and more specifically, to intermediate transfer members and processes involving intermediate transfer members.

RELATED APPLICATIONS

U.S. patent application Ser. No. 13/746,920, entitled "Thermally Switchable Transfix Blanket Made with Grafted Switchable Polymer for Aqueous Inkjet Printing," which is being filed concurrently herewith, describes a polymer composition comprising a first polymer layer comprising a base polymer matrix, and a second polymer layer grafted onto the first polymer layer, wherein the second polymer layer comprises a stimulus-responsive polymer, and the surface free energy of the stimulus-responsive polymer is reversibly adjustable from a first surface free energy state to a second surface free energy state when heated to a predetermined critical activation temperature.

U.S. Patent Application Publication No. 2010/0251914 to Zhou et al. describes an imaging member comprising a substrate and a surface layer comprising a heat sensitive material permitting reversible switching between compatible and non-compatible states within one second.

The entire disclosures of the above-mentioned applications are totally incorporated herein by reference.

BACKGROUND

Indirect printing methods generally include a two-step printing process involving first applying ink imagewise onto an intermediate transfer member (such as a drum or a belt) using an inkjet printhead to form a transient image, and then transferring the transient image to a substrate. When the ink is applied onto the intermediate transfer member (also called, for example, an intermediate receiving member, a blanket, or a transfix blanket), it wets or spreads to form a transient image. The transient image then undergoes a change in properties (such as partial or complete drying, thermal or photo-curing, gelation, and so forth), and is transferred to the substrate. An exemplary offset or indirect printing process is disclosed in U.S. Pat. No. 5,389,958, the disclosure of which is incorporated herein by reference.

Intermediate transfer members suitable for use in indirect printing desirably exhibit surface properties (such as energy, topology, and so forth) that meet the sub-system requirements of the inkjet/transfix printing architecture, including wetting of the ink and subsequently (such as after phase change or the like) transferring the transient image (that is, the residual ink film along with pigment) onto a substrate. Several classes of materials may be used to form intermediate transfer members, including silicone, fluorosilicone, and Viton. However, these are hydrophobic materials, and the inherent low surface tension of these materials precludes wetting of aqueous ink drops. A higher surface tension material may be used to form the intermediate transfer member, but the high surface tension of such materials would impede efficient transfer of the image from the intermediate transfer member.

Because the surface free energy requirements of the intermediate transfer member desirable for wetting the ink are different than those for transferring the transient image, intermediate transfer members that display good wettability do not efficiently transfer the ink film onto a substrate, and conversely, intermediate transfer members that efficiently transfer the image to the substrate do not wet the ink. Thus, to date, intermediate transfer members have not enabled both functions (that is, both wetting and transfer).

In view of the above, there is a continuous need for improving intermediate transfer members used in indirect printing methods.

SUMMARY

The present disclosure provides a polymer composition containing a stimulus-responsive polymer dispersed in a base polymer matrix. The surface free energy of the stimulus-responsive polymer may be reversibly adjustable from a first surface free energy state to a second surface free energy state when heated to a predetermined critical activation temperature.

The present disclosure also provides a method of preparing a polymer composition which involves dispersing a stimulus-responsive polymer in a base polymer matrix. The surface free energy of the stimulus-responsive polymer may be reversibly adjustable from a first surface free energy state to a second surface free energy state when heated to a predetermined critical activation temperature.

The present disclosure further provides a method of printing an image to a substrate involving applying an aqueous inkjet ink onto an intermediate transfer member using an inkjet printhead, spreading the ink onto the intermediate transfer member, inducing a property change of the ink, and transferring the ink to a substrate. The intermediate transfer member may contain a stimulus responsive-polymer dispersed in a base polymer matrix, where the surface free energy of the stimulus-responsive polymer may be reversibly adjustable from a first surface free energy state to a second surface free energy state when heated to a predetermined critical activation temperature.

EMBODIMENTS

Figure 1:
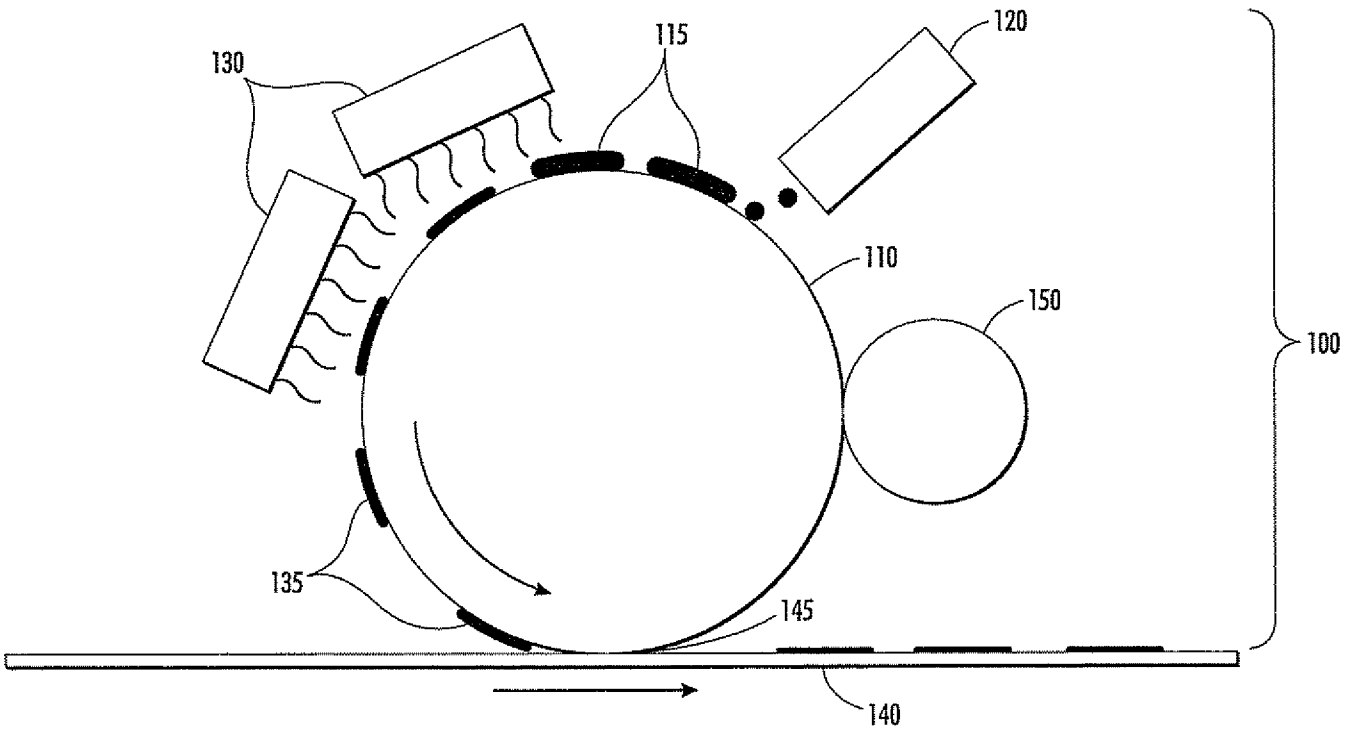
FIG. 1 is a schematic representation of a two-step printing process.

The present disclosure provides a polymer composition comprising a stimulus-responsive polymer dispersed in a base polymer matrix. In embodiments, the surface free energy of the stimulus-responsive polymer may be reversibly adjusted from a first surface free energy state to a second surface free energy state when heated to a predetermined critical activation temperature.

Intermediate transfer members incorporating such polymer compositions may switch their surface free energy in response to a stimulus (such as being heated to a critical activation temperature) and, thus, the surface free energy of the intermediate transfer members may be adjusted, for example, to enable both wetting and transfer. Such intermediate transfer members may therefore exhibit good wettability while also being able to efficiently transfer the transient image to the substrate. Because such intermediate transfer members may improve both ink spreading and ink transfer—as opposed to optimizing one at the expense of the other— they consequently yield an improved image quality. The intermediate transfer members according to the instant disclosure may be easily prepared (such as by blending the components) and display high wear resistance.

As used herein, the modifier "about" used in connection with a quantity is inclusive of the stated value and has the meaning dictated by the context (for example, it includes at least the degree of error associated with the measurement of the particular quantity). When used in the context of a range, the modifier "about" should also be considered as disclosing the range defined by the absolute values of the two endpoints. For example, the range "from about 2 to about 4" also discloses the range "from 2 to 4."

The terms "hydrocarbon" and "alkane" refer, for example, to branched and unbranched molecules having the general formula $C_nH_{2n+2}$, in which n is a number of 1 or more, such as from about 1 to about 60. Exemplary alkanes include methane, ethane, n-propane, isopropane, n-butane, isobutene, tort-butane, octane, decane, tetradecane, hexadecane, eicosane, tetracosane, and the like. Alkanes may be substituted by replacing hydrogen atoms with one or more functional groups to form alkane derivative compounds.

The term "functional group" refers, for example, to a group of atoms arranged in a way that determines the chemical properties of the group and the molecule to which it is attached. Examples of functional groups include halogen atoms, hydroxyl groups, carboxylic acid groups, and the like.

The term "alkyl group" refers, for example, to hydrocarbon groups that are linear or branched, saturated or unsaturated, and cyclic or acyclic, and with from about 1 to about 50 carbon atoms, such as from about 5 to about 35 carbon atoms, or from about 6 to about 28 carbon atoms.

The term "oleophobic" refers, for example, to a physical property of a molecule relating to having a lack of a strong affinity for oils. Water and fluorocarbons can be examples of oleophobic compounds. The term "oleophilic" refers, for example, to a physical property of a molecule relating to having an affinity for oils.

Indirect Printing

FIG. 1 shows one embodiment of a printing apparatus according to the present disclosure. The printing apparatus 100 comprises an intermediate transfer member 110. In the illustrated embodiment, the intermediate transfer member is a cylinder (such as a drum); however, the intermediate transfer member may be in alternate forms. More specifically, the intermediate transfer member may be in the form of an endless flexible belt, a web, a flexible drum or roller, a rigid roller or cylinder, a sheet, a drelt (a cross between a drum and a belt), a seamless belt, that is with an absence of any seams or visible joints in the members, and the like.

In the depicted embodiment, the intermediate transfer member 110 rotates counterclockwise. The apparatus includes an inkjet printhead 120, which applies ink imagewise onto the intermediate transfer member 110. The ink wets and spreads on the intermediate transfer member 110 to form the transient image 115. The transient image 115 then undergoes a change in properties (such as partial or complete drying, thermal or photo-curing, gelation, and so forth). The change in properties may be induced, for example, by a property-change device 130.

After the image undergoes a change in properties, the resulting post-phase-change transient image 135 may be transferred to a recording medium or printing substrate 140. The intermediate transfer member 110 may undergo a change in properties to further enable transfer. For example, because the surface free energy desirable for transfer is lower than the surface free energy desirable for wetting, the surface free energy of the intermediate transfer member 110 may be switched to a surface free energy state that enables wetting, and then switched to a surface free energy state to enable transfer of the transient image to the substrate. In the depicted embodiment, the recording medium or printing substrate 140, such as paper, may be fed to a nip region 145 in the direction of the arrow. The ink image may then be transferred from the intermediate transfer member 110 to the printing substrate 140. A cleaning unit 150 may clean the intermediate transfer member 110 of any residual ink, dust, or other materials after transfer of the ink images has been completed.

In embodiments, an indirect printing process according to the instant disclosure may use an intermediate transfer member including a polymer composition containing a stimulus-responsive polymer dispersed in a base polymer matrix, where the surface free energy of the polymer composition may be reversibly adjusted from a first surface free energy state to a second surface free energy state when heated to a predetermined critical activation temperature. In embodiments, the surface free energy of the intermediate transfer member may be adjusted by exposing the intermediate transfer member to a stimulus. For example, in embodiments, the surface free energy of the polymer composition (and the intermediate transfer member containing such a polymer composition) may be reversibly adjusted from a first surface free energy state to a second surface free energy state by heating the polymer composition to a predetermined critical activation temperature.

For example, in embodiments, the polymer composition may reversibly switch from a relatively higher first surface free energy state to a relatively lower second surface free energy state when heated to a temperature at or greater than a predetermined activation temperature. When the temperature of the polymer composition is less than the predetermined critical activation temperature, the polymer composition may switch to the relatively higher surface free energy state. Thus, in embodiments, the surface free energy of the polymer composition may be switched reversibly and controllably when heated between two states: a higher surface free energy state and a lower surface free energy state. In embodiments, the lower surface free energy state may enable transfer while the higher surface free energy state may enable spreading (wetting). A surface free energy state that enables the spreading (wetting) step may have a surface free energy that is greater than the surface tension of the liquid ink, while a surface free energy state that enables transfer may have a surface free energy that is lower than the surface free energy of the dry (resin) ink.

In embodiments, the surface free energy of the stimulus-responsive polymer in the first surface free energy state may be from about 26 to about 70 dynes/cm, such as from about 30 to about 60 dynes/cm, or from about 35 to about 55 dynes/cm. The second surface free energy state may be, for example, from about 3 to about 25 dynes/cm, such as from about 10 to about 23 dynes/cm, or from about 15 to about 20 dynes/cm. In embodiments, the difference between the second surface free energy state and the first surface free energy state may be greater than about 1, such as greater than about 10, or greater than about 20, such as a difference of from about 1 to about 67 dynes/cm, or from about 10 to about 60 dynes/cm, or from about 20 to about 50 dynes/cm.

In embodiments, ink may be jetted onto the intermediate transfer member when the intermediate transfer member is in a surface free energy state that enables wetting of the ink. Heat or other stimulus may then be applied to the intermediate transfer member to increase the temperature of the intermediate transfer member above the critical activation temperature, thereby switching the surface free energy to a state that will increase the efficiency of the transfer of ink from the intermediate transfer member to a substrate.

Any suitable temperature source may be used to cause the temperature change in the intermediate transfer member. Exemplary heat sources include a heat lamp, an optical heating device such as a laser or an LED bar including IR light LED bar, a thermal print head, resistive heating fingers, or a microheater array. A resistive heating finger is an array of finger-like micro-electrodes that result in resistive heating when the fingers are in contact with the surface that is to be heated. In embodiments, the heat used to switch the intermediate transfer member to its release state (i.e., lower surface energy) is provided at the time of the phase change process during the process, by the property change device 130. In embodiments, the intermediate transfer member may cool on its own by contact with the colder paper substrate and after the removal of heat. Optionally, an air jet could be used to accelerate cooling. This is particularly suitable for printing at very high speeds.

Intermediate Transfer Member

An intermediate transfer member suitable for the above-two step printing process desirably has surface properties (such as energy, topology, and so forth) both to enable wetting of the ink and to enable complete transfer of the transient image (residual ink film along with pigment) onto a substrate. For the ink to wet well (i.e., spread) onto the intermediate transfer member, the surface free energy of the intermediate transfer member is desirably higher than the surface tension of the liquid ink. For the ink to subsequently be transferred from the intermediate transfer member to the substrate, the surface free energy of the intermediate transfer member is desirably lower than the surface free energy of the dry (resin) ink. Thus, the surface free energy of the intermediate transfer member desirable for wetting the ink may be different from the surface free energy desirable for transferring the ink image to the substrate.

As a general matter, the wettability or spread of a liquid on a surface is governed by the forces of interaction between the liquid, the surface, and the surrounding air, and in particular the surface free energy, as relating to the surface chemistry and surface topology. Surface tension is a parameter that can be described as the interaction between the forces of cohesion and the forces of adhesion, which determines whether or not wetting, or the spreading of liquid across a surface, occurs.

Young's Equation, which defines the balance of forces caused by a wet drop on a dry surface, stipulates that:

$$\gamma_{SL}+\gamma_{LV}\cos\theta=\gamma_{SV}$$

where $\gamma_{SL}$=forces of interaction between a solid and liquid; $\gamma_{LV}$=forces of interaction between a liquid and surrounding air; $\gamma_{SV}$=forces of interaction between a solid and surrounding air; and $\theta$=contact angle of the drop of liquid in relation to the surface. Young's Equation also shows that, if the surface tension of the liquid is lower than the surface energy, the contact angle is zero and the liquid wets the surface. The surface energy depends on several factors, such as the chemical composition and crystallographic structure of the solid, and in particular of its surface, the geometric characteristics of the surface and its roughness, and the presence of molecules physically adsorbed or chemically bonded to the solid surface.

According to the instant disclosure, the surface free energy of the intermediate transfer member may be switched from a first surface free energy state to a second surface free energy state in response to a stimulus. For example, in embodiments, the surface free energy of the intermediate transfer member may be reversibly switched from a relatively higher surface free energy state to a relatively lower surface free energy state when heated to a predetermined critical activation temperature. However, the direction in which the stimulus-responsive polymer switches when heat is applied may vary. In some embodiments, the surface free energy of the stimulus-responsive polymer may increase when the stimulus-responsive polymer is heated above the critical activation temperature. In other embodiments, the surface free energy of the stimulus-responsive polymer may decrease when the stimulus-responsive polymer is heated above the critical activation temperature. Accordingly, in embodiments, the polymeric composition according to the instant disclosure may be hydrophilic at temperatures below the critical activation temperature, and hydrophobic at elevated temperatures. In other embodiments, the polymeric composition may be oleophilic at temperatures below the critical activation temperature and oleophobic at elevated temperatures.

In embodiments, an intermediate transfer member according to the instant disclosure may include a polymer composition containing a stimulus-responsive polymer dispersed in a base polymer matrix, where the surface free energy of the polymer composition may be reversibly adjusted from a first surface free energy state to a second surface free energy state when exposed to a predetermined critical activation temperature. More particularly, it is believed, the stimulus-responsive polymer itself exhibits the property that it reversibly adjusts from a first surface free energy state to a second surface free energy state when exposed to a predetermined critical activation temperature. In turn, because the stimulus-responsive polymer is dispersed in a base polymer matrix to form the polymer composition, the stimulus-responsive polymer, when incorporated into the polymer composition in an effective amount, imparts to the polymer composition as a whole the property of reversibly adjusting from a first surface free energy state to a second surface free energy state when exposed to a predetermined critical activation temperature.

In embodiments, the stimulus-responsive polymer may be responsive to a thermal stimulus. In embodiments, the stimulus-responsive polymer may be considered as switching states (i.e., between a relatively higher surface free energy and a relatively lower surface free energy) when heated to a temperature change of from about 10° C. to about 80° C., such as from about 10° C. to about 50° C., or from about 10° C. to about 20° C. (that is, a relative temperature difference). In embodiments, the stimulus-responsive polymer may switch states when heated to a temperature greater than about 10° C. and less than about 120° C., such as from about 25° C. to about 90° C., or from about 30° C. to about 60° C.

In embodiments, the stimulus-responsive polymer may comprise a poly-(N-alkylacrylamide) polymer. The poly-(N-alkylacrylamide) polymer may be, for example, a homopolymer or a copolymer comprising an acrylamide monomer. The poly-(N-alkylacrylamide) polymer may contain an N-alkylacrylamide unit of Formula (I):

Formula (I)

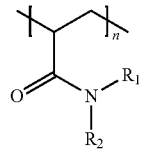

where the $R_1$ and $R_2$ groups are hydrogen or alkyl having from 1 to about 10 carbon atoms, such as from about 1 to about 6 carbon atoms, or cycloalkyl with a number of carbons from about 3 to about 10, or may be a heterocycle incorporating the N atom with a number of carbons from 3 to 5. However, not any combination of R groups may provide a thermally switchable polymer. Specific examples of suitable groups are shown in the Table 1, from Galaev, I. Y. and B. Mattiasson, 15(5) *Enzyme and Microbial Technology* 354 (1993), the disclosure of which is incorporated by reference herein in its entirety.

TABLE 1

Chemical structures, names, and transition temperatures of suitable thermally responsive poly(N-substituted acrylamides)

| $—NR_1R_2$ | Poly (N-alkylacrylamide) | Switching temperature [LCST] (° C.) |
|---|---|---|
| $NH—CH_2—CH_3$ | Poly(N-ethylacrylamide | 82 |
| $NH—CH_2—CH_2—CH_3$ | Poly(N-n-propylacrylamide) | 22 |
| $NH—CH—(CH_3)_2$ | Poly(N-isopropylacrylamide) | 32-34 |
| $N(CH_3)(CH_2—CH_3)$ | Poly(N-ethyl,N-methylacrylamide) | 56 |
| $N(CH_2—CH_3)_2$ | Poly(N,N-diethylacrylamide) | 32-42 |
| $N(CH_2—(CH_3)_2)(CH_3)$ | Poly(N-isopropyl,N-methylacrylamide) | 25 |
| 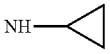 | Poly(N-cyclopropylacrylamide) | 47 |
| 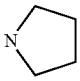 | Poly(N-acryloylpyrrolidine) | 55 |
| 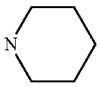 | Poly(N-acryloylpiperidine) | 4 |

All other combinations of alkyl groups with up to about 6 carbon atoms may not be thermally responsive. Some combinations with very small alkyl groups are fully soluble in water, such as polymers where the $NR_1R_2$ group is $NH_2$, $NHCH_3$, and $N(CH_3)_2$. Others are totally insoluble in water because the R groups render them too non-polar and do not allow the chain reconfiguration for thermal switching. Such examples include those where the $NR_1R_2$ group is $NH(CH_2CH_2CH_2CH_3)$, $NHC(CH_3)_3$, $N(CH_2CH_3)(CH_2CH_2CH_3)$, and $N(CH_2CH_2CH_3)_2$.

In embodiments, one or more than one of the above poly-(N-alkyl-acrylamides) can be grafted onto the surface of the first layer. This may be advantageous for fine-tuning the switching temperature of the final thermally responsive layer.

The switching temperature of the thereto-responsive polymer may be generally affected by the solvent and binder or polymer matrix in general. The values reported in Table 1 are for solutions in water. It has been shown previously that the presence of organic binder increases the switching temperature for a given thermally switchable material. For example, poly-(N-isopropylacrylamide) switches at 32° C. in water, but at 41° C. in mixture with an organic polymer such as SBR rubber. When dissolved in an organic solvent such as THF, the switching temperature shifted to 60° C. See N. Mori et al., *Temperature Induced Changes in the Surface Wettability of SBR+PNIPA Films,* 292 Macromol. Mater. Eng. 917, 917-22 (2007).

In embodiments, $R_1$ may be isopropyl and $R_2$ may be H, so that the acrylamide polymer is poly(N-isopropylacrylamide) (PNIPA) (i.e., the homopolymer) or an N-isopropylacrylamide copolymer. When the acrylamide polymer is an N-isopropylacrylamide (NIPAM) copolymer, the acrylamide monomer may comprise from about 30 to about 100% of the repeating units of the copolymer, or from about 30% to about 100 mole percent of the copolymer. The other comonomer of the copolymer may be, for example, styrene, bisphenol-A, acrylic acid, 4-vinylphenylboronic acid (VPBA), ethylmethacrylate; methylmethacrylate (MMA), butylmethacrylate (BMA), N,N-diethylaminoethyl methacrylate (DEAEMA), or methacrylic acid (MAA). The other comonomer could also be a fluorinated alkyl acrylate or fluorinated alkyl methacrylate, such as hexafluoroisopropylmethacrylate (HFIPMA) or 2,2,3,3,4,4-hexafluorobutylmethacrylate (HFBMA). The other comonomer could also be another acrylamide monomer, such as N-ethylacrylamide (NEAM), N-methylacrylamide (NMAM), N-n-propylacrylamide (NNPAM), N-t-butylacrylamide (NtBA), or N,N-dimethylacrylamide (DMAM).

In embodiments, the stimulus-responsive polymer may be PNIPA, having the following Formula (II):

Formula (II)

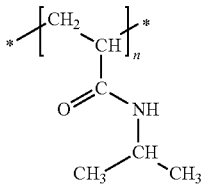

PNIPA where n may be an integer of from about 3 to about 1000, such as from about 5 to about 500, or from about 10 to about 300. PNIPA is a heat sensitive material that exhibits a large change in surface energy in response to a small change in temperature. See, for example, N. Mori et al., *Temperature Induced Changes in the Surface Wettabilily of SBR+PNIPA Films,* 292 Macromol. Mater. Eng. 917, 917-22 (2007), the entire disclosure of which is incorporated herein in its entirety. PNIPA has a hydrophobic isopropyl group on a side chain. It is soluble in water below 32° C. and becomes insoluble when heated above this critical temperature. This switching temperature (32° C.) between hydrophilic and hydrophobic states is called the lowest critical solution temperature (LCST). The contact angle of a water drop placed onto a PNIPA polymer film may change dramatically above and below the LCST—in one experiment, the contact angle of a water drop placed onto the PNIPA film changed from about 60° (hydrophilic) below 32° C. to over about 93° (hydrophobic) when heated above 32° C.

Figure 2:
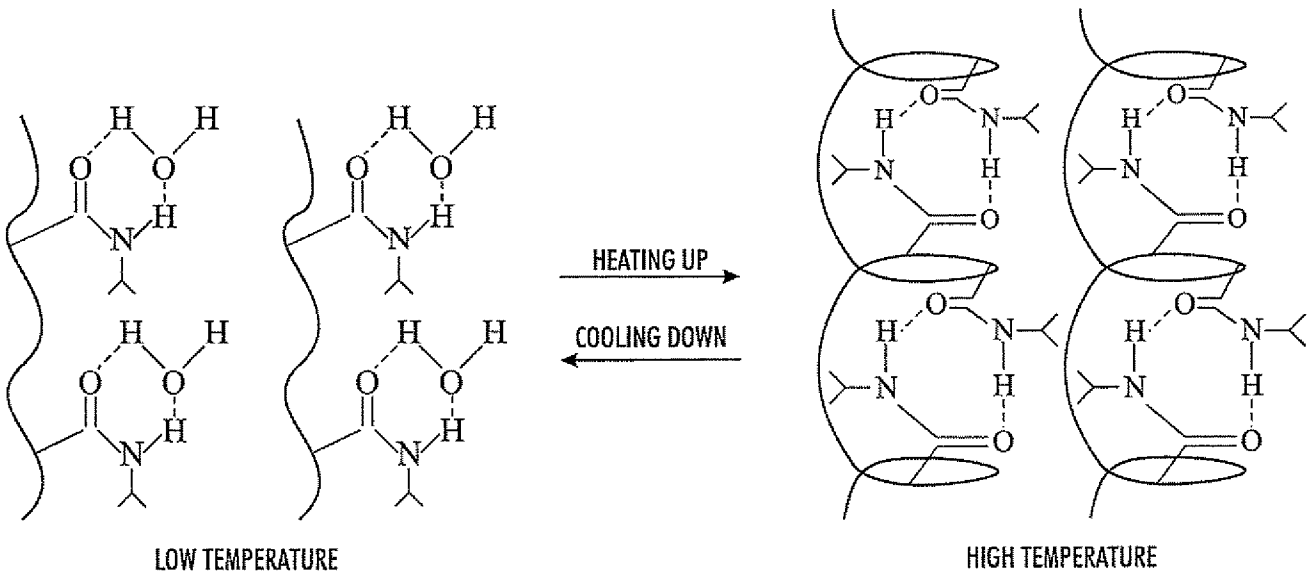
FIG. 2 is a diagram illustrating the difference in hydrogen bonding of a poly(n-isopropylacrylamide) polymer above and below a lower critical solution temperature (LCST).

Without being bound by any particular theory, it is believed that at a temperature below LCST, the PNIPA chains form expanded structures caused by intermolecular hydrogen bonding occurring predominantly between the PNIPA chains and the water molecules present in the applied solution. This intermolecular bonding contributes to the hydrophilicity of the PNIPA-modified surface. However, at temperatures above the LCST, hydrogen bonding occurs predominantly between the PNIPA chains themselves, with the carbonyl oxygen atom of one PNIPA chain bonding to the hydrogen atom on the nitrogen tom of the adjacent PNIPA chain. This intermolecular hydrogen bonding between the C═O and N—H groups of adjacent PNIPA chains results in a compact conformation wherein the C═O and N—H groups are not available to interact with water molecules, which results in hydrophobicity at temperatures above the LCST. These two states (i.e., when the temperature is less than the LCST and when the temperature is greater than the LCST) are illustrated in FIG. 2. This interaction is not dependent on the isopropyl chain, and thus should apply to other acrylamide polymers as well.

In embodiments, the active, switchable stimulus-responsive polymer may be dispersed in a base polymer matrix. The base polymer matrix may be any suitable material, such as those described in, for example, U.S. Patent Application Publication Nos. 2011/0244247, 2011/0104499, 2012/0049121, 2010/0330305, and 2011/0244202, the disclosures of which are incorporated by reference herein in their entireties.

In embodiments, the base polymer matrix may have a fixed surface free energy of from about 3 to about 25 dynes/cm, such as from about 10 to about 23 dynes/cm, or from about 15 to about 20 dynes/cm. In embodiments, the base polymer matrix may have a water contact angle of greater than about 80°, or greater than about 100°, such as from about 90 to about 135°.

In embodiments, suitable materials for a base polymer matrix include low surface energy materials such as TEFLON™-like materials including fluorinated ethylene propylene copolymer (FEP), polytetrafluoroethylene (PTFE), polyfluoroalkoxy polytetrafluoroethylene (PFA TEFLON™), and other TEFLON™-like materials; silicone materials, such as fluorosilicones, and silicone rubbers, such as room temperature vulcanization (RTV) silicone rubbers, high temperature vulcanization (HTV) silicone rubbers, and low temperature vulcanization (LTV) silicone rubbers. These rubbers are known and readily available commercially, such as SILASTIC™ 735 black RTV and SILASTIC™ 732 RTV, both from Dow Corning; 106 RTV Silicone Rubber and 90 RTV Silicone Rubber, both from General Electric; and JCR6115CLEAR HTV and SE4705U HTV silicone rubbers from Dow Corning Toray Silicones. Other suitable silicone materials include the siloxanes (such as polydimethylsiloxanes); fluorosilicones (including partially fluorinated fluorosilicones and fully fluorinated fluorosilicones) such as Silicone Rubber 552, available from Sampson Coatings, Richmond, Va.; liquid silicone rubbers such as vinyl crosslinked heat curable rubbers or silanol room temperature crosslinked materials; and the like. Another specific example is Dow Corning Sylgard 182. Commercially available LSR rubbers include Dow Corning Q3-6395, Q3-6396, SILASTIC™ 590 LSR, SILASTIC™ 591 LSR, SILASTIC™ 595 LSR, SILASTIC™ 596 LSR, and SILASTIC™ 598 LSR from Dow Corning.

Suitable materials for a base polymer matrix may also include fluoroelastomers. Fluoroelastomers are from the class of 1) copolymers of two of vinylidenefluoride, hexafluoropropylene, and tetrafluoroethylene; 2) terpolymers of vinylidenefluoride, hexafluoropropylene, and tetrafluoroethylene; and 3) tetrapolymers of vinylidenefluoride, hexafluoropropylene, tetrafluoroethylene, and cure site monomer. These fluoroelastomers are known commercially under various designations such as VITON A™, VITON B™, VITON E™, VITON E 60C™, VITON E430™, VITON 910™, VITON GH™, VITON GF™, and VITON ETP™. The VITON™ designation is a Trademark of E.I. DuPont de Nemours, Inc. The cure site monomer can be 4-bromoperfluorobutene-1,1,1-dihydro-4-bromoperfluorobutene-1,3-bromoperfluoropropene-1,1,1-dihydro-3-bromoperfluoropropene-1, or any other suitable, known cure site monomer, such as those commercially available from DuPont. Other commercially available fluoropolymers include FLUOREL 2170™, FLUOREL 2174™, FLUOREL 2176™, FLUOREL 2177™ and FLUOREL LVS 76™, FLUOREL™ being a registered trademark of 3M Company. Additional commercially available materials include AFLAS™, a poly(propylene-tetrafluoroethylene), and FLUOREL II™ (LII900), a poly(propylene-tetrafluoroethylenevinylidenefluoride), both also available from 3M Company, as well as the Tecnoflons identified as FOR-60KIR™, FOR-LHF™, NM. FOR-THF™, FOR-TFS™, TH™, NH™, P757™, TNS™, T439™, μL958™, BR9151™ and TN505™ available from Ausimont. The cure site monomer can be those available from E.I. DuPont de Nemours, Inc., such as 4-bromoperfluorobutene-1,1,1-dihydro-4-bromoperfluorobutene-1,3-bromoperfluoropropene-1,1,1-dihydro-3-bromoperfluoropropene-1, or any other suitable, known, commercially available cure site monomer.

The stimulus-responsive polymer is blended with the base polymer matrix to form the polymer composition in an effective amount to impart to the polymer composition the desired property and degree of surface free energy adjustment. In embodiments, the stimulus-responsive polymer is dispersed in the base polymer matrix in proportions of from about 5 to about 80% compared to the matrix polymer, such as from about 10% to about 70%, or from about 15% to about 50%.

Characterization of the wetting properties of an intermediate transfer member containing the polymer composition may be carried out by measuring the water droplet contact angle at a given temperature. In embodiments, the contact angle represents an average of the wetting performance of the base materials and the stimulus-responsive polymer. In embodiments, below the critical activation temperature, an intermediate transfer member according to the instant disclosure may have a water contact angle of from about 80° to about 150°, such as from about 90° to about 140°, or from about 100° to about 130°. In embodiments, at or above the critical activation temperature, an intermediate transfer member may have a water contact angle of from about 10° to about 70°, such as from about 15° to about 50°, or from about 20° to about 45°.

In embodiments, the degree of wettability change (that is, the difference in wettability between the polymer composition in the first surface free energy state and the second surface free energy state) may be adjusted through selection and concentration of the components of the blend. In embodiments, the blended polymer may include from about 50% to about 95% of a polymer base material having a relatively low surface free energy (that is, in embodiments, having a fixed surface free energy of from about 3 to about 25 dynes/cm, such as from about 10 to about 23 dynes/cm, or from about 15 to about 20 dynes/cm), and, thus, the wetting of the surface may be switched between a less hydrophobic and a more hydrophobic state. In embodiments, the degree of wettability change may be controlled by selection of a particular base polymer matrix (i.e., a base polymer matrix having a desired surface free energy), as well as by adjustment of the concentration of the stimulus-responsive polymer in the blend. In embodiments, the difference between the contact angle in the first surface free energy state and the contact angle of the polymer composition in the second surface free energy state may be from about 5° to about 140°, such as from about 10° to about 100°, or from about 10° to about 60°.

Ink Materials

Any ink suitable for use in an indirect printing method may be used. Exemplary ink compositions include, for example, phase change inks, gel based inks, curable inks, aqueous inks, and solvent inks. The term "ink composition" refers, for example, to all colors of a particular ink composition including, for example, usable color sets of an ink composition. For example, an ink composition may refer to a usable color set of phase change ink that includes cyan, magenta, yellow, and black inks. Therefore, as defined herein, cyan phase change ink and magenta phase change ink are different ink colors of the same ink composition.

The term "phase change ink," also referred to as "solid ink," refers, for example, to inks that remain in a solid phase at ambient temperature and that melt to a liquid phase when heated above a threshold temperature, referred to in some instances as a melt temperature. The ambient temperature is the temperature of the air surrounding the imaging device; however, the ambient temperature may be at room temperature (about 20° C. to about 25° C.) when the imaging device is positioned in an enclosed or otherwise defined space. Melt temperatures for phase change ink may be, for example, from about 70° C. to about 140° C., such as from about 80° C. to about 100° C., or from about 110° C. to about 130° C. When phase change ink cools below the melt temperature, the ink returns to the solid phase.

As used herein, the terms "gel ink" and "gel based ink" refer, for example, to inks that remain in a gelatinous state at the ambient temperature and that may be heated or otherwise altered to have a different viscosity suitable for ejection by a printhead. Gel ink in the gelatinous state may have a viscosity, for example, between from about $10^5$ and $10^7$ centipoise (cP); however, the viscosity of gel ink may be reduced to a liquid-like viscosity by heating the ink above a threshold temperature, referred to as a gelation temperature. The gelation temperature may be, for example from about 30° C. to about 50° C., such as from about 31° C. to about 38° C., or from about 41° C. to about 48° C. The viscosity of the gel ink increases when the ink cools below the gelation temperature.

Some ink compositions, referred to herein as curable inks, may be cured by the imaging device. As used herein, the process of "curing" ink refers to curable compounds in an ink undergoing an increase in molecular weight in response to being exposed to radiation. Exemplary processes for increasing the molecular weight of a curable compound include, for example, crosslinking and chain lengthening. Cured ink is suitable for document distribution, is resistant to smudging, and may be handled by a user. Radiation suitable to cure ink may encompass the full frequency (or wavelength) spectrum including, for example, microwaves, infrared, visible, ultraviolet, and x-rays. For instance, ultraviolet-curable gel ink, referred to herein as UV gel ink, becomes cured after being exposed to ultraviolet radiation. As used herein, the term "ultraviolet" radiation encompasses radiation having a wavelength of from about 50 nm to about 500 nm.

In embodiments, an ink suitable for use in the above-described two-step printing process may have surface tension, viscosity, and particle size suitable for use in a piezoelectric inkjet printhead. In embodiments, the surface tension of the jettable ink may be from about 15 to about 50 dynes/cm, such as from about 18 to about 45 dynes/cm, or from about 20 to about 40 dynes/cm, or from about 22 to about 32 dynes/cm. The viscosity of the jettable inks may be, for example, from about 1 to about 30 centipoise (cps) at 30° C., such as from about 3 to about 20 cps, or from about 5 to about 18 cps, or from about 6 to about 17 cps. In embodiments, the particle size of the jettable inks may be less than about 600 nm, such as less than about 300 nm, or less than about 150 nm.

Method of Making an Intermediate Transfer Member

A polymer composition comprising a stimulus-responsive polymer dispersed in a base polymer matrix, wherein the surface free energy of the polymer composition is be reversibly adjusted from a first surface free energy state to a second surface free energy state when exposed to a predetermined critical activation temperature, may be produced using any suitable method. For example, the composition may be produced by dispersing a stimulus-responsive polymer in a base polymer matrix, such as by mixing.

In embodiments, the stimulus-responsive polymer may be dispersed in the base polymer matrix in the presence of a solvent. Suitable solvents include water and/or organic solvents including toluene, benzene, xylene, tetrahydrofuran (THF), acetone, acetonitrile, carbon tetrachloride, chlorobenzene, cyclohexane, diethyl ether, dimethyl ether, dimethyl formamide, heptane, hexane, methylene, chloride, pentane, combinations thereof, and the like.

In embodiments, the polymer mixture may undergo blanket coating to produce the intermediate transfer member. The polymer mixture may be coated at any appropriate temperature. In embodiments, the polymer mixture may be coated at a temperature of from about 35° C. to about 55° C., or from about 40° C. to about 50° C., such as about 40° C., in order to maintain compatibility in the hydrophobic state. In embodiments, the polymer mixture may be cast or surface coated.

Casting involves pouring the polymer mixture into a mold, and then curing. In embodiments, the polymer mixture may be cured over a time period of from about 0.5 hours to about 6 hours, such as from about 1 hour to about 5 hours, or from about 2 hours to about 4 hours. The polymer mixture may be cured at an appropriate temperature, such as from about 90° C. to about 200° C., or from about 100° C. to about 150° C., or from about 110° C. to about 130° C.

In embodiments, the polymer composition may be deposited on a substrate. Any suitable substrate may be used. In embodiments, the substrate may include, for example, metals, rubbers, and fabrics. Metals include steel, aluminum, nickel, and their alloys, and like metals and alloys of like metals. Examples of suitable rubbers include ethylene propylene dienes, fluoroelastomers, n-butyl rubbers, silicone rubbers and other elastomers and the like. A fabric material, as used herein, refers to a textile structure comprised of mechanically interlocked fibers or filaments, which may be woven or nonwoven. Fabrics are materials made from fibers or threads and woven, knitted, or pressed into a cloth or felt type structures. Woven, as used herein, refers to closely oriented by warp and filler strands at right angles to each other. Nonwoven, as used herein, refers to randomly integrated fibers or filaments. Examples of fabrics include woven or nonwoven cotton fabric, graphite fabric, fiberglass, woven or nonwoven polyimide (for example, KEVLAR™, available from DuPont), woven or nonwoven polyamide, such as nylon or polyphenylene isophthalamide (for example, NOMEX™, of E.I. DuPont of Wilmington, Del.), polyester, aramids, polycarbonate, polyacryl, polystyrene, polyethylene, polypropylene, cellulose, polysulfone, polyxylene, polyacetal, and the like, and mixtures thereof. The substrate may have a thickness of from about 1 to about 70 mm, such as from about 10 to about 65 mm, or from about 30 to about 60 mm.

The polymer composition may be deposited on the substrate by any suitable process. Exemplary methods for depositing the polymer composition on the substrate include drawdown coating, spray coating, spin coating, flow coating, dipping, spraying such as by multiple spray applications of very fine thin films, casting, web-coating, roll-coating, extrusion molding, laminating, or the like. The thickness of the surface coating may be from about 5 to about 500 microns thick, such as from about 10 to about 400 microns, or from about 20 to about 300 microns. The surface coating may be cured for a time period of from about 0.5 hours to about 6 hours, such as from about 1 hour to about 5 hours, or from about 2 hours to about 4 hours, at an appropriate temperature, such as from about 90° C. to about 200° C., or from about 100° C. to about 150° C., or from about 110° C. to about 130° C.

EXAMPLES

The following examples are being submitted to illustrate embodiments of the present disclosure. These examples are intended to be illustrative only and are not intended to limit the scope of the present disclosure. Parts and percentages are by weight unless otherwise indicated.

Example 1

Preparation of an Intermediate Transfer Member

A polymer composition may be prepared as follows. Part A of a commercially available, crosslinkable PDMS two component system (such as can be obtained from, for example, Dow Corning Corporation) is mixed with 20% by weight of PNIPA polymer in a suitable organic solvent. The polymer mixture is then mixed with Part B of the commercially available, crosslinkable PDMS two-component system, where the PDMS curing agent is present in a ratio of 10 to 1 compared to the amount of Part A. The resulting mixture is degassed for 20 minutes and then stirred at 40° C. prior to blanket coating.

The polymer mixture may be coated at 40° C. in order to maintain compatibility in the hydrophobic state. The polymer mixture may be either cast or surface coated.

For example, in embodiments, the polymer mixture may be cast by pouring the polymer mixture into a mold, then curing for 2-4 hours at 120° C.

In embodiments, the polymer mixture may be surface coated on a suitable substrate by a suitable method, such as draw-down coating, spray coating, spin coating, or flow coating, yielding a surface coating that is from about 20 to about 300 microns thick, which is cured for 2-4 hours at 120° C.

In embodiments, a thermally responsive polymer terminated with a functional group may be used. The terminal functional group present in the thermally responsive polymer may be beneficial because it may improve compatibility of the thermally responsive polymer with the binder material. Suitable functional groups include carboxylic acid, amino, N-hydroxysuccinimide ester, maleinamide, and triethoxysilane. Triethoxysilane terminated poly-(N-alkylacrylpolyamide) is particularly suitable for providing enhanced compatibility with blanket base materials such as silicones and siloxyfluorocarbon base materials. Suitable polymer compounds are commercially available. For example, poly-(N-isopropylacrylamide), carboxylic acid terminated average $M_n$, 5,000 and $M_n$ 7,000, as well as poly(N-isopropylacrylamide), N-hydroxysuccinimide (NHS) ester terminated average $M_n$ 2,000 and triethoxysilane terminated poly-(N-isopropylacrylamide) are commercially available from Sigma-Aldrich (Delaware).

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A polymer composition comprising a stimulus-responsive polymer dispersed in a base polymer matrix, wherein the surface free energy of the stimulus-responsive polymer is reversibly adjustable from a first surface free energy state to a second surface free energy state when heated to a predetermined critical activation temperature.

2. The polymer composition according to claim 1, wherein the surface free energy of the first surface free energy state is from about 26 to about 70 dynes/cm, and the surface free energy of the second surface free energy state is from about 3 to about 25 dynes/cm, and the difference between the surface free energy of the first surface free energy state and the second surface free energy state is greater than about 1 dyne/cm.

3. The polymer composition according to claim 1, wherein the surface free energy of the base polymer matrix is from about 3 to about 25 dynes/cm.

4. The polymer composition according to claim 1, wherein the stimulus-responsive polymer comprises a monomer unit selected from the group consisting of N-isopropylacrylamide, N-ethylacrylamide, N-n-propylacrylamide, N-ethyl,N-methylacrylamide, N,N-diethylacrylamide, N-isopropyl,N-methylacrylamide, N-cyclopropylacrylamide, N-acryloylpyrrolidine, and N-acryloylpiperidine and mixtures thereof.

5. The polymer composition according to claim 1, wherein the stimulus-responsive polymer is selected from the group consisting of poly-(N-isopropylacrylamide), poly-(N-ethylacrylamide), poly-(N-n-propylacrylamide), poly(N-ethyl, N-methylacrylamide), poly(N,N-diethylacrylamide), poly (N-isopropyl,N-methylacrylamide), poly(N-cyclopropylacrylamide), poly(N-acryloylpyrrolidine), and poly(N-acryloylpiperidine) and mixtures thereof.

6. The polymer composition according to claim 1, wherein the predetermined critical activation temperature is from about 10° C. to about 120° C.

7. The polymer composition according to claim 1, wherein the base polymer matrix is selected from the group consisting of silicones, fluoropolymers, fluorinated polyimide, and networked siloxyfluorocarbons.

8. The polymer composition according to claim 1, wherein the stimulus-responsive polymer is present in an amount of from about 5% to about 50% compared to the base polymer matrix.

9. A transfix blanket comprising the polymer composition according to claim 1.

10. A printing apparatus comprising:

a transfix blanket comprising the polymer composition according to claim 1.

11. A method of preparing a polymer composition, the method comprising:

dispersing a stimulus-responsive polymer in a base polymer matrix;

wherein the surface free energy of the stimulus-responsive polymer is reversibly adjustable from a first surface free energy state to a second free energy state when heated to a predetermined critical activation temperature.

12. The method according to claim 11, wherein the stimulus-responsive polymer is present in an amount of from about 5% to about 50% compared to the base polymer matrix.

13. A method of printing an image to a substrate comprising:

applying an inkjet ink onto an intermediate transfer member using an inkjet printhead;

spreading the ink onto the intermediate transfer member;

inducing a property change of the ink; and transferring the ink to a substrate;

wherein the intermediate transfer member comprises a stimulus-responsive polymer dispersed in a base polymer matrix, wherein the surface free energy of the stimulus-responsive polymer is reversibly adjustable from a first surface free energy state to a second surface free energy state when heated to a predetermined critical activation temperature.

14. The method according to claim 13, wherein the surface free energy of the first surface free energy state is from about 26 to about 70 dynes/cm, and the surface free energy of the second surface free energy state is from about 3 to about 25 dynes/cm, and the difference between the surface free energy of the first surface free energy state and the second surface free energy state is greater than about 1 dyne/cm.

15. The method according to claim 13, wherein the surface free energy of the base polymer matrix is from about 3 to about 25 dynes/cm.

16. The method according to claim 13, wherein the stimulus-responsive polymer comprises a monomer unit selected from the group consisting of N-isopropylacrylamide, N-ethylacrylamide, N-n-propylacrylamide, N-ethyl,N-methylacrylamide, N,N-diethylacrylamide, N-isopropyl,N-methylacrylamide, N-cyclopropylacrylamide, N-acryloylpyrrolidine, N-acryloylpiperidine and mixtures thereof.

17. The method according to claim 13, wherein the stimulus-responsive polymer is selected from the group consisting of poly-N-isopropylacrylamide, poly-(N-ethylacrylamide), poly-(N-n-propylacrylamide), poly(N-ethyl,N-methylacrylamide), poly(N,N-diethylacrylamide), poly(N-isopropyl,N-methylacrylamide), poly(N-cyclopropylacrylamide), poly (N-acryloylpyrrolidine), and poly(N-acryloylpiperidine) and mixtures thereof.

18. The method according to claim 13, wherein the predetermined critical activation temperature is from about 10° C. to about 120° C.

19. The method according to claim 13, wherein the base polymer matrix is selected from the group consisting of silicones, fluoropolymers, fluorinated polyimide, and networked siloxyfluorocarbons.

20. The method according to claim 13, wherein the stimulus-responsive polymer is present in an amount of from about 5% to about 50% compared to the base polymer matrix.

* * * * *